United States Patent [19]

Dutra

[11] 4,258,952

[45] Mar. 31, 1981

[54] ROCKING COUCH, CHAISE, LOUNGE, RECLINER, CHAIR OR RELAXER

[76] Inventor: Antonio S. Dutra, 2949 Driftwood Dr., San Jose, Calif. 95128

[21] Appl. No.: 969,929

[22] Filed: Dec. 15, 1978

[51] Int. Cl.[3] ..... A47C 3/029; A47C 1/02

[52] U.S. Cl. ..... 297/258; 248/364; 297/217; 297/313

[58] Field of Search ..... 5/368–370; 297/258, 260, 270, 217, 313, ; 272/28 R, 32, 33 R, 33 A, 49, 50, 51, 1 R; 248/143, 364

[56] References Cited

U.S. PATENT DOCUMENTS

| | | | |
|---|---|---|---|
| 3,041,070 | 6/1962 | Kerstein | 297/258 X |
| 3,477,713 | 11/1969 | Cudmore | 272/33 A |
| 4,109,960 | 8/1978 | Stinchfield | 297/258 |

FOREIGN PATENT DOCUMENTS

| | | | |
|---|---|---|---|
| 600359 | 11/1925 | France | 248/143 |
| 1491608 | 8/1967 | France | 297/258 |
| 6712562 | 3/1968 | Netherlands | 297/258 |
| 54631 | 11/1934 | Norway | 272/33 A |

*Primary Examiner*—James T. McCall
*Attorney, Agent, or Firm*—Thomas E. Schatzel

[57] ABSTRACT

This invention is a reclining and rocking article of furniture comprising as an integral part of its construction a structural body shaped in a unique way to allow for a smooth reclining transition from a sitting to a lying down position while the user experiences full body support, and a variable weight positioned in such a way as to serve as a leverage device for balancing the article and as a means to facilitate rocking motion.

6 Claims, 2 Drawing Figures

ROCKING COUCH, CHAISE, LOUNGE, RECLINER, CHAIR OR RELAXER

BACKGROUND OF THE INVENTION

Figure 1:
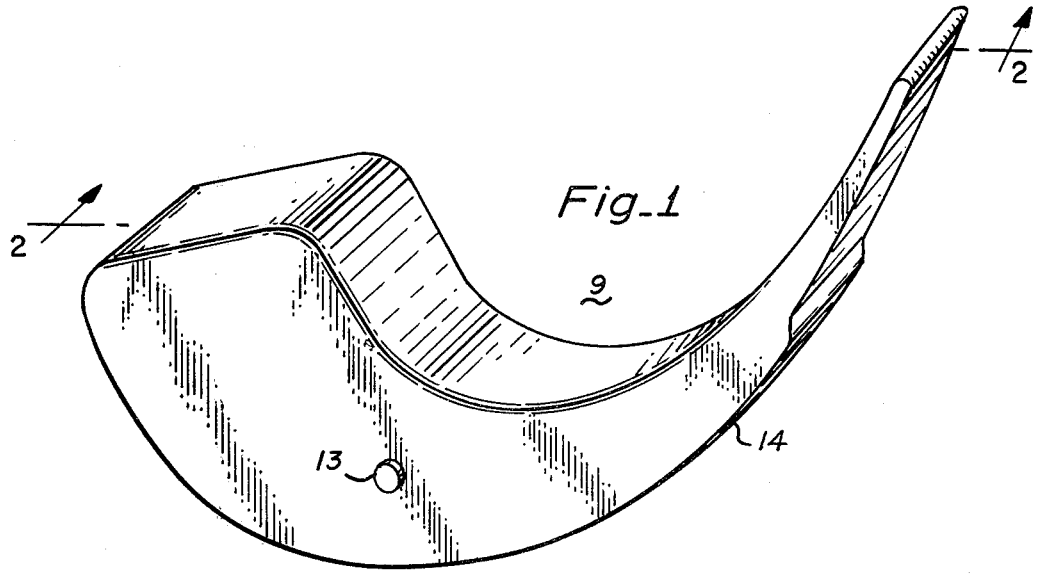

This invention comes within the field of furniture or more specifically in the class of couches, chairs and seats with means to impart rocking motion.

Briefly, the presently preferred embodiment of the present invention is a uniquely shaped reclining, rocking article of furniture provided with interior cavities and means of varying and maintaining different weight distributions in the cavities. The body may be made of wood, plastic, steel, rattan or any other feasible material on any different combination, and the weights may be in the form of water, sand or any other liquid or flowable solid material. The inventor conceived this new and unique piece of furniture having in mind the simple and easy manufacturing of a practical and effective way to fulfill the human need to be and feel relaxed with a minimum effort and reduced cost. The inventor believes, after extensive research and testing on the prototype, that the comfort and relaxation achieved by lying on this piece of furniture is of unquestionable value. The inventor is convinced that this real comfort is due to the unique contoured shape of the resting surface. This shape allows the user, once on the lying position, to rest with the hip area and vertabrae free from weight and pressure, the legs, back and neck fully supported and the feet on a higher lever than the body. These facts, in combination with the unique method of imparting rocking motion as applied to this kind of furniture, minimize muscle exertion.

After searching for prior art, the inventor concluded that, to the best of his knowledge, there are no other existing products alike or similar to which this invention can be compared.

IN THE DRAWING

Figure 2:
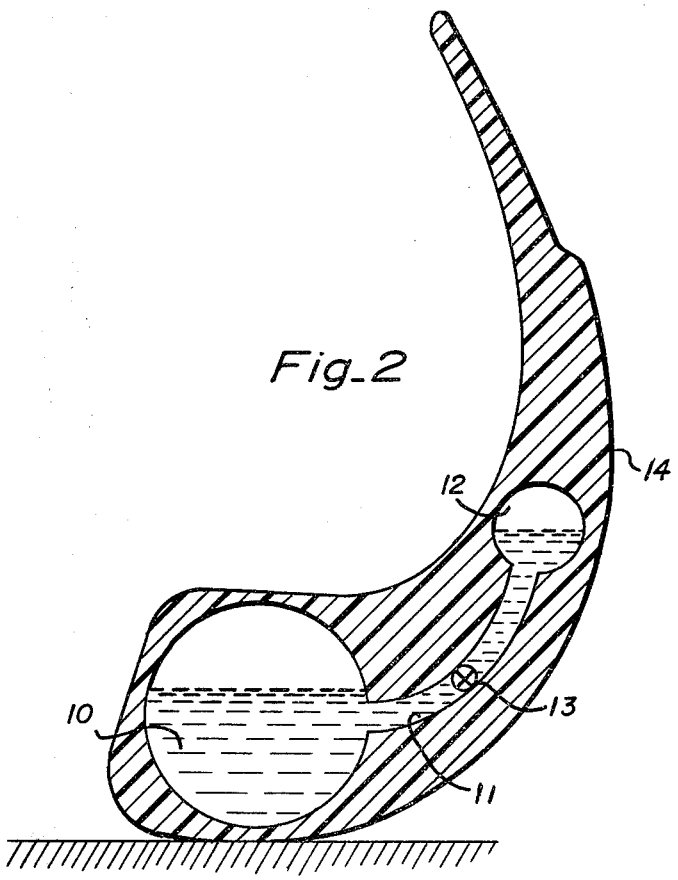

FIG. 1 is a perspective view of a preferred embodiment of the present invention shown in a reclined position; and FIG. 2 is a cross-sectional view, taken along line 2—2 of FIG. 1, with the reclined rocker shown in the upright position.

In reference to FIGS. 1 and 2, a reclining rocker 9 of the present invention is illustrated. Reclining Rocker 9 has a tank 10 installed on the lower portion thereof. Tank 10 once full of water, will act as the weight leverage for smooth reclining and rocking motion. A tube 11 connects this tank 10 to another smaller tank 12. Control valve 13 serves as the control device for moving the water from one tank to the other, as necessary according to the differing personal weights of the users. The back of this piece of furniture 14 is curved in the shape of a section of an oval for smooth reclining from the sitting to the lying position.

Having thus described the invention, I desire to protect it by Letters of Patent, and what I claim is:

1. A reclining, rocking article of furniture comprising:

a frame member including a back rest portion and a seat rest portion, said portions being integrally jointed to form a continuous curved back and bottom surface upon which the article may rock and recline and further forming a top and front surface adapted to support a human body in a sitting position, either upright or reclined;

a first enclosed cavity situated within the interior of said seat rest portion of the frame member;

a second enclosed cavity situated within the interior of said back rest portion of the frame member;

a tube means situated within the interior of the frame interconnecting the first and second enclosed cavities;

a flowable ballast of relatively high density filling some but significantly less than all of the combined volumes of the first enclosed cavity, the ballast flowing through the tube means between the cavities under the force of gravity; and valve means situated within the tube means so as to fill a segment of the tube means for controlling the relative distribution of the ballast between the first enclosed cavity and the second enclosed cavity, the valve means including an open condition under which the ballast freely flows through the tube means and under which the distribution of ballast may be adjusted by altering the relative heights of the first and second enclosed cavities and a closed condition under which no ballast may flow in either direction through the valve means or the tube means, and valve control means for selecting said open condition or said closed condition, said valve control means being accessible from the exterior of the frame.

2. A reclining, rocking article of furniture as recited in claim 1 wherein:

a vertical cross section of said back and bottom surface is in the general shape of an arc of an oval.

3. A reclining, rocking article of furniture as recited in claim 1 wherein:

said top and front surface of said frame is generally concavely shaped with a flattened area about said seat rest portion such that a human body is supported upon said top and front surface as on a curved back chair when the article is in an upright orientation and as in a shallow trough when the article is in a reclining orientation.

4. A reclining, rocking article of furniture as recited in claim 1 wherein:

the first enclosed cavity is a large spherical tank; and the second enclosed cavity is a spherical tank smaller than that of the first enclosed cavity.

5. A reclining, rocking article of furniture as recited in claim 1 wherein:

the flowable ballast is water.

6. A reclining, rocking article of furniture as recited in claim 1 wherein:

a vertical cross section of the frame member is shaped so as to resemble an inverted comma.

* * * * *